US005878913A

United States Patent [19]

Fisher et al.

[11] Patent Number: 5,878,913

[45] Date of Patent: Mar. 9, 1999

[54] WHISTLING AEROSOL CAN

[76] Inventors: William E. Fisher; Maggie Fisher, both of 3054 Marie Ct., Merced, Calif. 95340

[21] Appl. No.: 970,009

[22] Filed: Nov. 13, 1997

[51] Int. Cl.[6] ..... G08B 23/00

[52] U.S. Cl. ..... 222/39; 222/402.1; 239/72; 116/137; 116/DIG. 44

[58] Field of Search ..... 222/39, 402.1, 222/192; 239/72, 289; 116/DIG. 44, 137 R, 139

[56] References Cited

U.S. PATENT DOCUMENTS 4,227,482 10/1980 Scheindel ..... 222/39
4,572,406 2/1986 Pratt et al. ..... 222/39
4,674,654 6/1987 Fujii et al. ..... 222/39

*Primary Examiner*—Steven O. Douglas

[57] ABSTRACT

A whistling aerosol can for providing a remote indication that the can is being utilized to dispense its contents. The device includes a valve assembly disposed atop a can and being in communication with contents therein. The valve assembly includes a dispensing cap. The dispensing cap has an L-shaped dispensing channel therein. The dispensing channel has a vertical portion extending downwardly into communication with an internal dispensing tube of the can. The dispensing channel has a horizontal portion extending outwardly of the dispensing cap. The horizontal portion has a whistle positioned therein inwardly of an outlet end thereof.

1 Claim, 2 Drawing Sheets

FIG 3
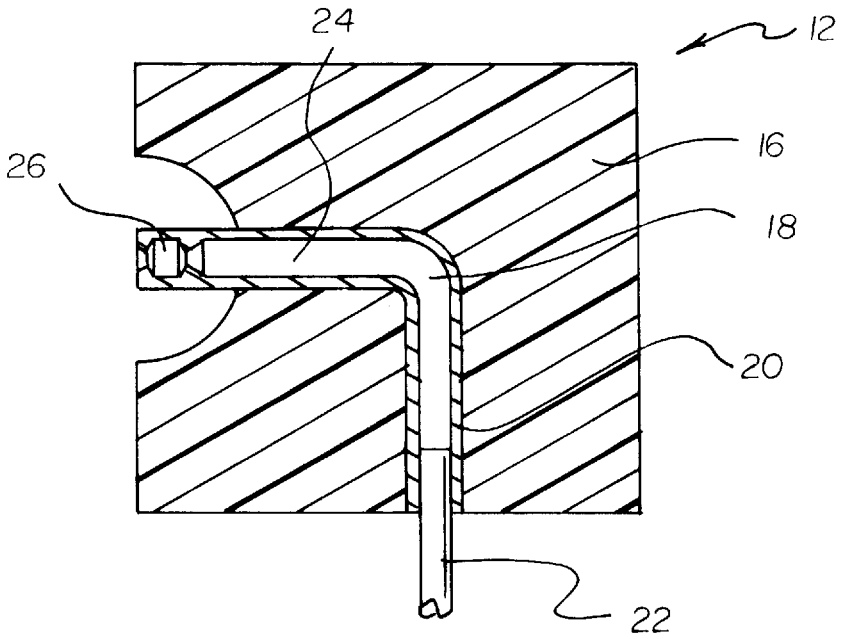
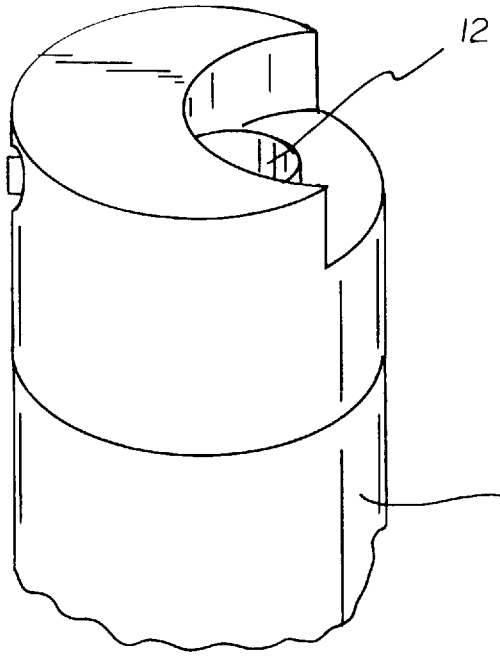
FIG 4

WHISTLING AEROSOL CAN

BACKGROUND OF THE INVENTION

1. Field of the Invention

The present invention relates to aerosol containers and more particularly pertains to a new whistling aerosol can for providing a remote indication that the can is being utilized to dispense its contents.

2. Description of the Prior Art

The use of aerosol containers is known in the prior art. More specifically, aerosol containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art aerosol containers include U.S. Pat. No. 4,759,309 to Zediker; U.S. Pat. No. 4,449,474 to Mariol; U.S. Pat. No. 3,990,639 to Laauwe; U.S. Pat. No. 3,912,131 to Friedman et al.; U.S. Pat. No. 4,341,330 to Mascia et al.; and U.S. Pat. No. Des. 299,810 to Trickett.

While these devices fulfill their respective, particular objectives and requirements, the aforementioned patents do not disclose a new whistling aerosol can. The inventive device includes a valve assembly disposed atop a can and being in communication with contents therein. The valve assembly includes a dispensing cap. The dispensing cap has an L-shaped dispensing channel therein. The dispensing channel has a vertical portion extending downwardly into communication with an internal dispensing tube of the can. The dispensing channel has a horizontal portion extending outwardly of the dispensing cap. The horizontal portion has a whistle positioned therein inwardly of an outlet end thereof.

In these respects, the whistling aerosol can according to the present invention substantially departs from the conventional concepts and designs of the prior art, and in so doing provides an apparatus primarily developed for the purpose of providing a remote indication that the can is being utilized to dispense its contents.

SUMMARY OF THE INVENTION

In view of the foregoing disadvantages inherent in the known types of aerosol containers now present in the prior art, the present invention provides a new whistling aerosol can construction wherein the same can be utilized for providing a remote indication that the can is being utilized to dispense its contents.

The general purpose of the present invention, which will be described subsequently in greater detail, is to provide a new whistling aerosol can apparatus and method which has many of the advantages of the aerosol containers mentioned heretofore and many novel features that result in a new whistling aerosol can which is not anticipated, rendered obvious, suggested, or even implied by any of the prior art aerosol containers, either alone or in any combination thereof.

To attain this, the present invention generally comprises a valve assembly disposed atop a can and being in communication with contents therein. The valve assembly includes a dispensing cap. The dispensing cap has an L-shaped dispensing channel therein. The dispensing channel has a vertical portion extending downwardly into communication with an internal dispensing tube of the can. The dispensing channel has a horizontal portion extending outwardly of the dispensing cap. The horizontal portion has a whistle positioned therein inwardly of an outlet end thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new whistling aerosol can apparatus and method which has many of the advantages of the aerosol containers mentioned heretofore and many novel features that result in a new whistling aerosol can which is not anticipated, rendered obvious, suggested, or even implied by any of the prior art aerosol containers, either alone or in any combination thereof.

It is another object of the present invention to provide a new whistling aerosol can which may be easily and efficiently manufactured and marketed.

It is a further object of the present invention to provide a new whistling aerosol can which is of a durable and reliable construction.

An even further object of the present invention is to provide a new whistling aerosol can which is susceptible of a low cost of manufacture with regard to both materials and labor, and which accordingly is then susceptible of low prices of sale to the consuming public, thereby making such whistling aerosol can economically available to the buying public.

Still yet another object of the present invention is to provide a new whistling aerosol can which provides in the apparatuses and methods of the prior art some of the advantages thereof, while simultaneously overcoming some of the disadvantages normally associated therewith.

Still another object of the present invention is to provide a new whistling aerosol can for providing a remote indication that the can is being utilized to dispense its contents.

Yet another object of the present invention is to provide a new whistling aerosol can which includes a valve assembly disposed atop a can and being in communication with contents therein. The valve assembly includes a dispensing cap. The dispensing cap has an L-shaped dispensing channel therein. The dispensing channel has a vertical portion extending downwardly into communication with an internal dispensing tube of the can. The dispensing channel has a horizontal portion extending outwardly of the dispensing cap. The horizontal portion has a whistle positioned therein inwardly of an outlet end thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view of the present invention as taken along line 3—3 of FIG. 2.

FIG. 4 is a partial perspective view of an alternate use of the present invention.

DESCRIPTION OF THE PREFERRED EMBODIMENT

Figure 1:
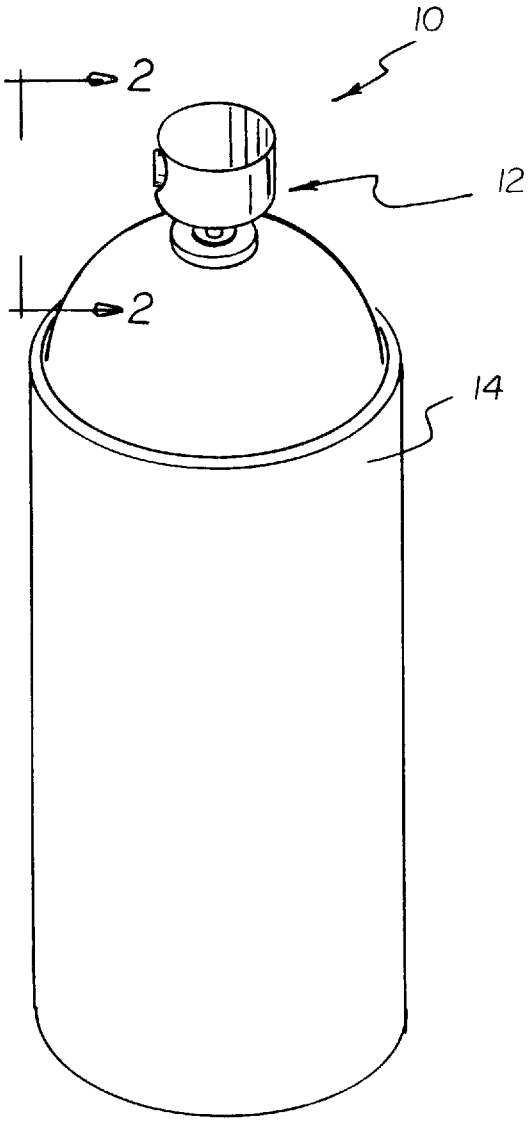
FIG. 1 is a top perspective view of a new whistling aerosol can according to the present invention.
Figure 2:
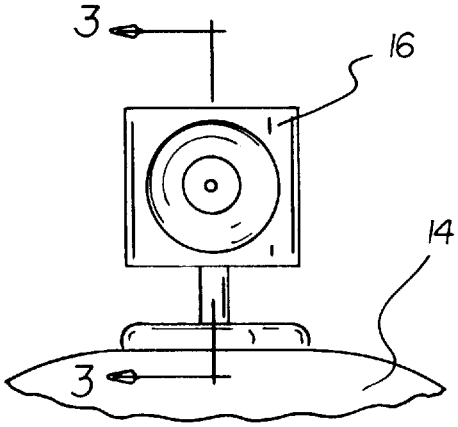
FIG. 2 is a front view of the present invention as taken along line 2—2 of FIG. 1.

With reference now to the drawings, and in particular to FIGS. 1 through 4 thereof, a new whistling aerosol can embodying the principles and concepts of the present invention and generally designated by the reference numeral 10 will be described.

As best illustrated in FIGS. 1 through 4, the whistling aerosol can 10 comprises a valve assembly 12 disposed atop a can 14 and being in communication with contents therein. The can 14 is of a conventional configuration and the can 14 can take the form of a variety of sizes and styles. The can 14 is provided with an opening in its top end for coupling with the valve assembly 12. The valve assembly 12 includes a dispensing cap 16. The dispensing cap 16 has an L-shaped dispensing channel 18 therein. The dispensing channel 18 has a vertical portion 20 extending downwardly into communication with an internal dispensing tube 22 of the can 14. The dispensing channel 18 has a horizontal portion 24 extending outwardly of the dispensing cap 16. The horizontal portion 24 has a whistle 26 positioned therein inwardly of an outlet end thereof.

In use, the present invention provides a remote indication that the can 14 is being utilized to dispense its contents. When the user presses down on the dispensing cap 16 to release pressure from within the can and to allow the contents to be dispensed through the dispensing channel 18. As the contents exit outwardly of the dispensing channel 18, their passage through the whistle 26 will cause an audible signal. The whistle 26 will cause a signal similar to that of a tea kettle. Thus, when the device 10 is used without permission, the whistle 26 will alert that such use is occurring.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A whistling aerosol can for providing a remote indication that the can is being utilized to dispense its contents comprising, in combination:

a valve assembly disposed atop a can and being in communication with contents therein, the valve assembly including a dispensing cap with a cylindrical configuration having a circular top face, a circular bottom face, and a tubular periphery formed therebetween, the dispensing cap having a hemispherical recess formed in the periphery thereof and an L-shaped dispensing channel therein, the dispensing channel having a vertical portion extending downwardly into communication with an internal dispensing tube of the can, the dispensing channel having a horizontal portion extending outwardly of the dispensing cap through the hemispherical recess in coaxial relationship therewith to a point flush with the periphery of the dispensing cap, the horizontal portion having a whistle positioned therein inwardly of an outlet end thereof, the whistle comprising an inboard frusto-conical portion tapering radially inward towards the outlet, an outboard frusto-conical portion tapering radially outward toward the outlet, and an intermediate portion defined by a central cylindrical extent and a pair of tapering end extents which are in communication between the inboard frusto-conical portion and the outboard frusto-conical portion and further in coaxial alignment therewith.

* * * * *